United States Patent [19]

Sasaki et al.

[11] 4,374,616

[45] Feb. 22, 1983

[54] IMAGE-FORMING APPARATUS HAVING A PHOTOSENSITIVE MEMBER TRANSFER MECHANISM

[75] Inventors: Koichi Sasaki, Higashi; Hiroshi Ishida, Ibaragi; Yasuji Sumida, Nara; Akira Tanaka, Kyoto, all of Japan

[73] Assignee: Mita Industrial Co., Ltd., Osaka, Japan

[21] Appl. No.: 276,627

[22] Filed: Jun. 24, 1981

[30] Foreign Application Priority Data

Jun. 30, 1980 [JP] Japan ..... 55-91813[U]

[51] Int. Cl.[3] ..... G03G 15/00

[52] U.S. Cl. ..... 355/3 CH; 355/8; 355/14 CH; 355/14 E

[58] Field of Search ..... 355/3 CH, 8, 14 CH, 355/50, 14 E

[56] References Cited

U.S. PATENT DOCUMENTS 3,697,165 10/1972 Morriston et al. ..... 355/50 X
4,026,647 5/1977 Kanno et al. ..... 355/14 SH X
4,148,578 4/1979 Butese ..... 355/8
4,159,173 6/1979 Kasuga ..... 355/3 SH X
4,171,901 10/1979 Takizawa et al. ..... 355/8

*Primary Examiner*—A. C. Prescott
*Attorney, Agent, or Firm*—Joseph A. DeGrandi; Richard G. Kline; Robert G. Weilacher

[57] ABSTRACT

An image-forming apparatus comprising an original-support plate for placing an original document thereon, a photosensitive member support stand disposed opposite to, and beneath, said original-support plate for placing a photosensitive member thereon, a charging-exposing unit for forming a latent electrostatic image corresponding to the original document on the photosensitive member, said charging-exposing unit being mounted between the original-support plate and the photosensitive member support stand for transverse reciprocation, and a power driving source for moving said charging-exposing unit reciprocally. The charging-exposing unit includes a mechanism for feeding the photosensitive member. During the return movement of the charging-exposing unit, the photosensitive member transfer mechanism acts on the photosensitive member placed on said support stand to move the photosensitive member incident to the return movement of the charging-exposing unit.

4 Claims, 5 Drawing Figures

IMAGE-FORMING APPARATUS HAVING A PHOTOSENSITIVE MEMBER TRANSFER MECHANISM

FIELD OF THE INVENTION

This invention relates to an image-forming apparatus, and more specifically, to an image-forming apparatus of the type in which a charging-exposing unit is moved in a predetermined direction relative to an original document and a photosensitive member in a stationary condition, thereby forming a latent electrostatic image corresponding to the image of the original document on the photosensitive member.

DESCRIPTION OF THE PRIOR ART

As the aforesaid type of image-forming apparatus, there is known an image-forming apparatus comprising an original-support plate, a photosensitive member-support stand disposed opposite to, and beneath, the original-support plate, a charging-exposing unit mounted between the original-support plate and the photosensitive member-support stand for transverse reciprocation, and a power driving source for moving the charging-exposing unit reciprocally. In such an image-forming apparatus, an original document to be copied is placed on the original-support plate, and a photosensitive member is placed on the photosensitive member-support stand. The charging-exposing unit is caused to reciprocate in a predetermined direction to charge the surface of the photosensitive member, scan the image of the original document and project it on the photosensitive member. This results in the formation of a latent electrostatic image corresponding to the image of the original on the surface of the photosensitive member. Then, the charging-exposing unit is moved back to its original position for the next cycle of latent electrostatic image formation.

It will be readily appreciated that in such an image-forming apparatus, after the charging-exposing unit has been moved forth to form a latent electrostatic image on the surface of the photosensitive member, the photosensitive member existing on the stand needs to be transferred in a required direction. In the conventional image-forming apparatus, the photosensitive member-support stand is constructed of a transfer belt mechanism including an endless belt to be driven, so that after the formation of a latent electrostatic image, the endless belt is caused to run in a required direction to transfer the photosensitive member on the endless belt in the required direction.

The conventional image-forming apparatus, however, has the defect that the transfer belt mechanism constituting the photosensitive member-support stand is relatively complex and expensive and therefore the cost of production is relatively high. In the conventional apparatus, that part of the endless belt in the stationary state on which the photosensitive member is placed should be maintained exactly in the substantially flat and immobile state during the formation of a latent electrostatic image (otherwise the photosensitive member would not be maintained in the required state on the endless belt during the image formation, and a distortion or other defects would occur in the latent electrostatic image formed on the surface of the photosensitive member). In order to meet this requirement, a special belt-holding means must be provided in the transfer belt mechanism and owing to this belt-holding means, the transfer belt mechanism would become more complex and expensive.

SUMMARY OF THE INVENTION

It is an object of this invention to provide a novel and improved image-forming apparatus which includes a very simple and inexpensive mechanism for transferring a photosensitive member on a photosensitive member-support stand in a required direction after formation of a latent electrostatic image on the surface of the photosensitive member, and therefore obviates the need to construct the photosensitive member-support stand with a relatively complex and expensive transfer belt mechanism and permits a considerable reduction in the cost of production as compared with the conventional image-forming apparatus.

Extensive investigations of the present inventors have led to the discovery that by skillfully utilizing the return movement of the charging-exposing unit for transfer of the photosensitive member from the support stand, there can be provided a very simple and inexpensive mechanism by which the photosensitive member can be transferred in a required direction from the support stand after a latent electrostatic image is formed on the surface of the photosensitive member by the forward movement of the charging-exposing unit.

Thus, according to this invention, there is provided an image-forming apparatus comprising an original-support plate for placing an original document thereon, a photosensitive member-support stand disposed opposite to, and beneath, said original-support plate for placing a photosensitive member thereon, a charging-exposing unit for forming a latent electrostatic image corresponding to the original document on the photosensitive member, said charging-exposing unit being mounted between the original-support plate and the photosensitive member support stand for transverse reciprocation, a power driving source for moving said charging-exposing unit reciprocally, and a mechanism annexed to said charging-exposing unit for transferring the photosensitive member, said mechanism being adapted to act on the photosensitive member placed on the support stand during the return movement of the charging-exposing unit to move the photosensitive member incident to the return movement of the charging-exposing unit.

DETAILED DESCRIPTION OF THE PREFERRED EMBODIMENTS

The invention is described in greater detail below with reference to the accompanying drawings which show one embodiment of the image-forming apparatus constructed in accordance with this invention.

Figure 1:
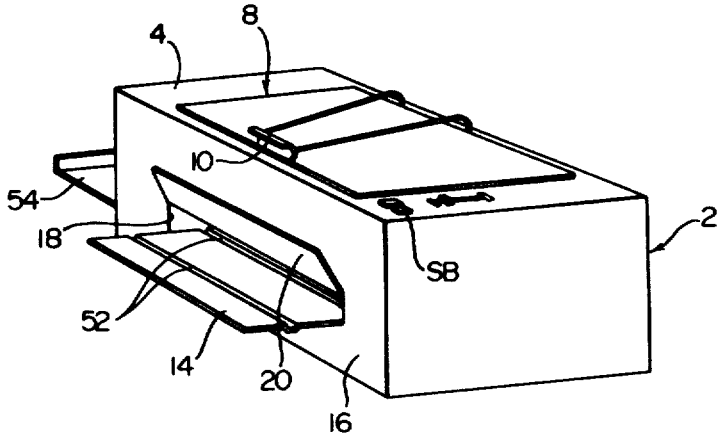
FIG. 1 is a perspective view showing one embodiment of the image-forming apparatus constructed in accordance with this invention.
Figure 2:
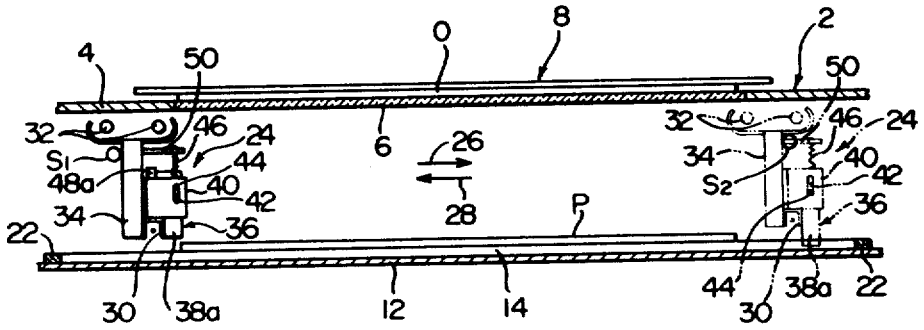
FIG. 2 is a sectional view showing a part of the image-forming apparatus shown in FIG. 1.

Referring to FIGS. 1 and 2, the image-forming apparatus of the invention has a rectangular housing shown generally at 2. As can be seen from FIG. 2, a rectangular opening is formed on a top surface wall 4 of the housing 2, and an original-support plate 6 which may be a transparent glass plate is fitted in the opening. Having regard to the original-support plate 6, an original-holding member shown generally at 8 is provided on the top surface wall 4 of the housing 2. By grasping a grasping portion 10 (FIG. 1) formed on the front edge of the original-holding member 8, it can be turned about an axis extending along its rear edge between a closed position at which it covers the original-support plate 6 and an open position at which the original-support plate 6 is brought to view, as shown in FIGS. 1 and 2.

As shown in FIG. 2, a horizontal support plate 12 is disposed at the bottom portion of the inside of the housing 2, and on the horizontal support plate 12 is arranged a photosensitive member-support stand 14 which may be made of a metallic or plastic plate-like material. As FIG. 1 shows, a rectangular opening 18 is formed in a front surface wall 16 of the housing 2, and a door 20 for the opening 18 is also provided therein. The support stand 14 disposed on the horizontal support plate 12 can be drawn forward through the opening 18 from its operative position within the housing 2 by opening the door 20. The movement of the support stand 14 on the horizontal support plate 12 in the forward-rearward direction (i.e., in the direction perpendicular to the sheet surface in FIG. 2) can be guided, for example, by a pair of guide rails rails 22 which extend in the forward-rearward direction and fixed to the top surface of the horizontal support plate 12 with a distance therebetween corresponding to the length of the support stand 14 in the transverse direction (i.e., the left and right directions in FIG. 2). When placed at the operative position within the housing, the support stand 14 is located opposite to, and beneath, the original-support plate 6 and substantially parallel thereto, as illustrated in FIG. 2.

A charging-exposing unit shown generally at 24 is provided between the original-support plate 6 and the supportstand 14. The charging-exposing unit 24 mounted by a suitable mounting means (not shown) such that it can reciprocate substantially horizontally in the transverse direction, i.e. in the directions shown by arrows 26 and 28, between its initial position shown by a solid line in FIG. 2 and a forward movement ending position shown by a two-dot chain line in FIG. 2. Furthermore, the charging-exposing unit 24 is drivingly connected to a power driving source, which may be an electric motor M (FIG. 5), through a suitable drivingly connecting means (not shown) so that it reciprocates in the directions 26 and 28 by means of the electric motor M. The charging-exposing unit 24 includes a corona discharge device 30, an original-illuminating lamp 32 and a light transmitting means 34. As the light transmitting means 34, there is conveniently used a device comprising a frame having an opening at its upper end surface and lower end surface and transversely extending rows of a plurality of vertically extending slender optical elements (an example of such optical elements is a so-called rod-like lens sold under the tradename "SELFOC MICROLENS" by Nippon Sheet Glass Co., Ltd., Japan).

It is essential that in the image-forming apparatus constructed in accordance with this invention, a photosensitive member transfer mechanism 36 reciprocable in the directions shown by arrows 26 and 28 is annexed to the charging-exposing mechanism 24.

Figure 3:
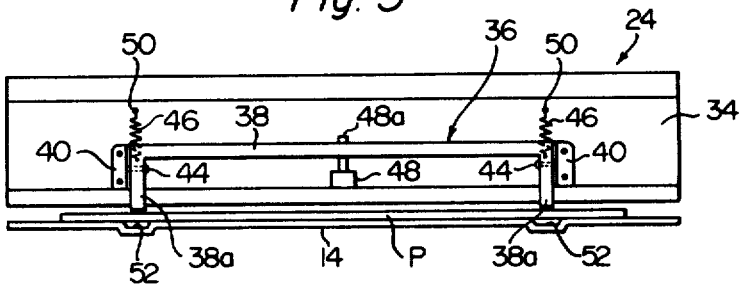
FIG. 3 is a partial side elevation showing that a transfer member in a photosensitive member transfer mechanism used in the image-forming apparatus in FIG. 1 is at an inoperative position.
Figure 4:
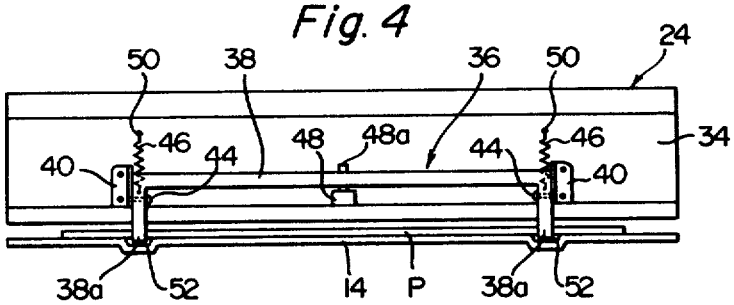
FIG. 4 is a partial side elevation, similar to FIG. 3, showing that the transfer member in the photosensitive member transfer mechanism used in the image-forming apparatus in FIG. 1 is at an operative position.

Referring to FIGS. 3 and 4 together with FIG. 2, the illustrated transfer mechanism 36 has a transfer member 38 with downwardly extending projections 38*a* formed at both ends. A pair of mounting brackets 40 having an L-shaped cross-section are fixed to the light transmitting means 34 in spaced-apart relation in the forward-rearward direction, and the transfer member 38 is mounted between the above pair of mounting brackets 40 such that it moves freely vertically between the non-operative position shown in FIG. 3 and the operative position shown in FIG. 4. In more detail, each of the mounting brackets 40 has a slot 42 extending vertically as shown in FIG. 2. A pin 44 is fixed to each of the projections 38*a* of the transfer member 38. The transfer member 38 is mounted between the mounting brackets 40 by inserting an outwardly projecting end of each of the pins 44 into each of the slots 42. It will be evident therefore that the transfer member 38 can move freely in the vertical direction between its uppermost position at which the pin 44 abuts the upper end of the slot 42, i.e. the inoperative position shown in FIG. 3, and its lowermost position at which the pin 44 abuts the lower end of the slot 42, i.e. the operative position illustrated in FIG. 4. Instead of forming slots 42 in a pair of brackets 40 and fixing pins to the projecting portions 38*a* of the transfer member 38, it is possible to fix pins to a pair of brackets 40 and to form slots for insertion of such pins at the projecting portions 38*a* of the transfer member 38.

The illustrated transfer mechanism 36 for the photosensitive member further includes a positioning means composed of a pair of spring members 46 and one electromagnetic solenoid 48 for selectively positioning the transfer member 38 at the inoperative position illustrated in FIG. 3 and the operative position illustrated in FIG. 4. Each of the spring members 46 is stretched between a stop pin 50 provided in the light transmitting means 34 and the upper end portion of the projection 38*a* of the transfer member 38, and elastically biases the transfer member 38 upwardly. On the other hand, an output rod 48*a* of the electromagnetic solenoid 48 mounted in the light transmitting means 34 is connected to the main portion of the transfer member 38. When the electromagnetic solenoid 48 is in the deenergized state, the transfer member 38 is elastically positioned at the inoperative position shown in FIG. 3 by the elastic biasing action of the spring member 46. On the other hand, when the electromagnetic solenoid 48 is energized, the transfer member 38 is caused to descend against the elastic biasing action of the spring member 46, and is thus positioned at the operative position shown in FIG. 4. If desired, however, it is of course possible to bias the transfer member 38 elastically at the operative position by the spring member when the electromagnetic solenoid is deenergized, and to raise the transfer member 38 against the elastic biasing action of the spring member and hold it at the enopetative position when the electromagnetic solenoid is energized.

In the illustrated embodiment, a pair of grooves 52 (see FIG. 1 also) extending in the reciprocating directions of the charging-exposing unit 24, i.e. the directions shown by arrows 26 and 28, are formed on the upper surface of the photosensitive member-support stand 14 corresponding to a pair of projections 38*a* of the transfer member 38. As clearly shown in FIG. 4, when the transfer member 38 is positioned at the operative position, the lower end portions of the projections 38*a* of the transfer member 38 are fitted into the grooves 52 respectively.

Figure 5:
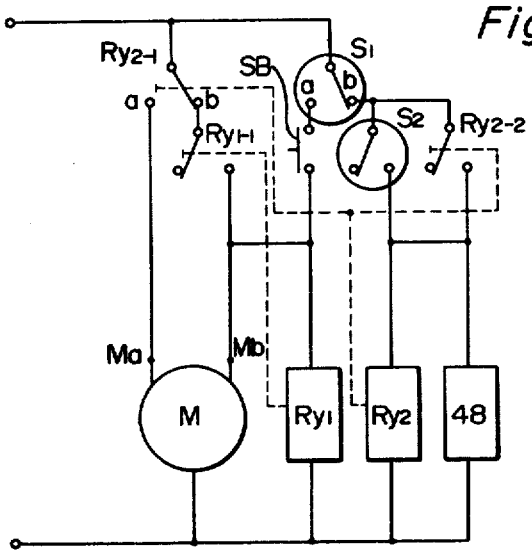
FIG. 5 is a circuit diagram showing a part of an electrical circuit used in the image-forming apparatus shown in FIG. 1.

The operation of the aforesaid image-forming apparatus will now be described with reference to FIGS. 1 to 4 and also FIG. 5 which shows an electrical circiut for controlling the reciprocation of the charging-exposing unit 24 and the operation of the photosensitive member transfer mechanism 36.

To form a latent electrostatic image corresponding to the image of an original on the photosensitive member by the image-forming apparatus described hereinabove, the original document 0 is placed at a given position on the original-support plate 6. Then, the original-holding member 8 is brought to a closed position to cover the original-support plate 6 and the original document 0 placed on it. Further, the door 20 provided at the front surface wall 16 of the housing 2 is opened and the support stand 14 for the photosensitive member is drawn forward from the operative position within the housing 2. A sheet-like photosensitive member P is placed at a given position on the support stand 14. Then, the support stand 14 is returned to the operative position within the housing 2 and the door 20 is closed. Thus, a preparatory operation comes to an end. At this time, the charging-exposing unit 24 is located at the initial position shown by a solid line in FIG. 2, and the electromagnetic solenoid 48 of the transfer mechanism 36 is in the deenergized state. Hence, the transfer mechanism 36 for the photosensitive member is located at the inoperative position illustrated in FIG. 3 and shown by a solid line in FIG. 2. When the charging-exposing unit 24 is at the initial position shown by a solid line in FIG. 2, a first switch $S_1$ (FIGS. 2 and 5) detects it, and a contact member of the first switch $S_1$ is kept in contact with a normally open contact a.

When a start button SB (FIGS. 1 and 5) is temporarily depressed in the above condition, an electric current is supplied to a normal rotation-inducing input terminal Mb of the electric motor M through the normally open contact a of the first switch $S_1$ and the start button SB to start normal rotation of the electric motor M. At the same time, an electric current is supplied to a first relay $Ry_1$ through the normally open contact a of the first switch $S_1$ and the start button SB to energize the first relay $Ry_1$ and close a relay switch $Ry_{1-1}$. Thus, the first relay $Ry_1$ is self-maintained in the energized state.

When the electric motor M begins to rotate in the normal direction, the charging-exposing unit 24 begins to move forward in the direction of an arrow 26 from the position shown by a solid line in FIG. 2. When the depression of the start button SB is released, the start button SB is opened, and when the charging-exposing unit 24 begins to move forward, the contact member of the first switch $S_1$ is switched over to a normally closed contact b. However, an electric current keeps flowing to the normal rotation-inducing input terminal Mb of the electric motor M through the relay switch $Ry_{1-1}$ of the first relay $Ry_1$, and therefore the electric motor M continues to rotate normally. As a result, the charging-exposing unit 24 keeps moving forward in the direction of arrow 26.

During the movement of the charging-exposing unit 24 from the initial position shown by a solid line in FIG. 2 to the forward movement ending position shown by a two-dot chain line in FIG. 2, the corona discharge device 30 and the original-illuminating lamp 32 are energized through a suitable control circuit (not shown). Hence, during the forward movement of the charging-exposing unit 24, the surface of the photosensitive member P is charged by the corona discharge device 30 and the light reflected from the original document 0 illuminated by the lamp 32 is irradiated on the surface of the photosensitive member P through the light transmitting means 34. Thus, a latent electrostatic image corresponding to the image of the original document 0 is formed on the surface of the photosensitive member P. In the meantime, the transfer member 38 of the photosensitive member-transfer mechanism 36 is held at the inoperative position shown in FIG. 3 and by a solid line in FIG. 2, and the lower ends of the projections 38*a* of the transfer member 38 are located above the photosensitive member P. Hence, the transfer member 38 does not act on the photosensitive member P during the forward movement of the charging-exposing unit 24.

When the charging-exposing unit 24 keeps moving forward and reaches the forward movement ending position shown by a two-dot chain line in FIG. 2, the corona discharge device 30 and the illuminating lamp 32 are deenergized by a suitable control circuit (not shown). Furthermore, a second switch $S_2$ (FIGS. 2 and 5) detects the charging-exposing unit 24 and is closed. Thus, an electric current is supplied through the normally closed contact b of the first switch $S_1$ and the second switch $S_2$ to energize the second relay $Ry_2$. As a result, the contact member of a relay switch $Ry_{2-1}$ of the second relay $Ry_2$ is switched from the normally closed contact b over to the normally open contact a and a relay switch $Ry_{2-2}$ of the second relay switch $Ry_2$ is closed. When the contact member of the relay switch $Ry_{2-1}$ is switched from the normally closed contact b to the normally open contact a, the first relay $Ry_1$ self-maintained till then is deenergized, and supply of current to the normal rotation-inducing input terminal Mb of the electric motor M is stopped. Furthermore, a current begins to be supplied to the reverse rotation-inducing input terminal Ma of the electric motor M through the normally open contact a of the relay switch $Ry_{2-1}$. Thus, the electric motor M stops normal rotation and begins to rotate in the reverse direction. Hence, the charging-exposing unit 24 stops moving in the direction of arrow 26 and begins to make a return movement in the direction of arrow 28. On the other hand, when the relay switch $Ry_{2-2}$ is closed, the second relay $Ry_2$ is self-maintained in the energized state and the electromagnetic solenoid 48 of the transfer mechanism 36 is energized. As a result, the transfer member 38 of the transfer mechanism 36 is held at the operative position illustrated in FIG. 4 and shown by a two-dot chain line in FIG. 2.

The second switch $S_2$ is again opened when the charging-exposing unit 24 begins to move backward from the forward movement ending position shown by a two-dot chain line in FIG. 2 in the direction of arrow 28. However, an electric current keeps flowing to the reverse rotation-inducing input terminal Ma of the electric motor M through the normally open contact a in the relay switch $Ry_{2-1}$ of the second relay $Ry_2$, and therefore, the electric motor M keeps rotating reversely and the charging-exposing unit 24 continues to make a return movement in the direction shown by arrow 28.

When the charging-exposing unit 24 makes a returning movement from the forward movement ending position shown by a two-dot chain line in FIG. 2 in the direction of arrow 28, the electromagnetic solenoid 48 of the transfer mechanism 36 is energized as stated above, and the transfer member 38 of the transfer mechanism 36 is held at the operative position illustrated in FIG. 3 and shown by a two-dot chain line in FIG. 2. It will be readily appreciated from FIG. 2 therefore that when the charging-exposing unit 24 is moved to some extent in the direction of arrow 28 from the forward movement ending position shown by a two-dot chain line in FIG. 2, a pair of the projections 38*a* of the transfer member 38 abut the rear edge (i.e., the right end edge in FIG. 2) of the photosensitive member P located on the support stand 14. Thereafter, the projections 38*a* of the transfer member 38 act on the rear edge of the photosensitive member P to exert a force tending in the direction of arrow 28 on the photosensitive member P. Accordingly, incident to the return movement of the charging-exposing unit 24 in the direction of arrow 28, the photosensitive member P positioned on the support stand 14 is moved and transferred from there in the direction of arrow 28.

When the charging-exposing unit 24 keeps moving backward and returns to the initial position shown by a solid line in FIG. 2, the first switch $S_1$ detects it. As a result, the contact member of the first switch $S_1$ is switched from the normally closed contact b over to the normally open contact a, the second relay $Ry_2$ self-maintained till then is deenergized, and the electromagnetic solenoid 48 of the transfer mechanism 36 is deenergized. Thus, the transfer member 38 of the transfer mechanism 36 is returned to the inoperative position illustrated in FIG. 3 and shown by a solid line in FIG. 2. Furthermore, the second relay $Ry_2$ is deenergized and the contact member of the relay switch $Ry_{2\text{-}1}$ is returned to the normally closed contact b from the normally open contact a. Hence, supply of current to the reverse rotation-inducing input terminal Ma of the electric motor M is stopped, and the electric motor M stops. Thus, the charging-exposing unit 24 is stopped at the initial position shown by a solid line in FIG. 2.

The photosensitive member P moved in the direction of arrow 28 from the support stand 14 in response to the return movement of the charging-exposing unit 24 is, if required, further transferred through a suitable mechanism (not shown), and then discharged into a receiver tray 54 (FIG. 1) disposed at one side wall of the housing 2. For example, if the photosensitive member P is a copying paper having photosensitivity, the photosensitive member P transferred in the direction of arrow 28 from the support stand 14 is conveyed to a suitable developing unit where the latent electrostatic image formed on its surface is developed to a toner image. The developed photosensitive member P is then conveyed to a suitable fixing unit where the toner image is fixed. Thereafter, the copy can be discharged into the receiver tray 54.

The image-forming apparatus described hereinabove can be conveniently utilized as a plate-making device for producing a master sheet for printing. In this case, a photosensitive plate-making sheet may be used as the photosensitive member to be placed on the support stand 14. A latent electrostatic image is formed on the surface of the photosensitive member P on the support stand 14. Then, the photosensitive member P is transferred through a suitable developing unit to develop the latent electrostatic image to a toner image. Further, the photosensitive member P is transferred through a suitable fixing unit to fix the toner image on the photosensitive member P. Thereafter, the photosensitive member P is discharged into the receiver tray 54 of the image-forming apparatus, and conveyed to a suitable off-machine surface-treating device where the photosensitive member P is subjected to a suitable surface treatment to render the image area oleophilic and the nonimage area oleophobic. Thus, a master sheet for printing can be obtained. If desired, the surface-treating device may be built in the image-forming apparatus so that prior to discharging into the receiver tray 54, the photosensitive member P is conveyed to the surface-treating device and the finished printing master sheet is then discharged into the receiver tray 54.

While the invention has been described hereinabove in detail with regard to one specific embodiment illustrated in the accompanying drawings, it should be understood that the invention is in no may limited to such a specific embodiment, and various changes and modifications are possible without departing from the scope of the invention.

What we claim is:

1. An image-forming apparatus comprising an original-support plate for placing an original document thereon; a photosensitive member support stand disposed opposite to, and beneath, said original-support plate for placing a photosensitive member thereon, a charging-exposing unit for forming a latent electrostatic image corresponding to the original document on the photosensitive member, said charging-exposing unit being mounted between the original-support plate and the photosensitive member support stand for transverse reciprocation, a power driving source for moving said charging-exposing unit reciprocally, and a mechanism annexed to said charging-exposing unit for transferring the photosensitive member, said mechanism being adapted to act on the photosensitive member placed on the support stand during the return movement of the charging-exposing unit to move the photosensitive incident to the return movement of the charging-exposing unit.

2. The apparatus of claim 1 wherein said transfer mechanism includes a transfer member mounted for movement between an operative position and an inoperative position and a positioning means for holding the transfer member at the inoperative position when the charging-exposing unit makes a forward movement and for holding the transfer member at the operative position when the charging-exposing unit makes a return movement.

3. The apparatus of claim 2 wherein the positioning means is composed of a spring member for elastically biasing the transfer member to the inoperative position or the operative position and an electromagnetic solenoid for holding the transfer member at the operative position or the inoperative position against the elastic biasing action of the spring member.

4. The apparatus of claim 2 or 3 wherein at least one groove extending in the reciprocating direction of the charging-exposing unit is formed on the surface of the photosensitive member support stand; the transfer member of the transfer mechanism has at least one projection whose end portion is fitted into said groove when the transfer member is held at the operative position; and during the return movement of the charging-exposing unit, the projection of the transfer member held at the operative position abuts the rear edge of the photosensitive member placed on the support stand thereby to move the photosensitive member incident to the return movement of the charging-exposing unit.

* * * * *